US008585338B2

(12) United States Patent
Wernersson et al.

(10) Patent No.: US 8,585,338 B2
(45) Date of Patent: Nov. 19, 2013

(54) RESILIENT FIXING ARRANGEMENT

(75) Inventors: Lars Håkan Wernersson, Lund (SE); Per Hammer, Ahus (SE)

(73) Assignee: Akoustos AB, Hollviken (SE)

( * ) Notice: Subject to any disclaimer, the term of this patent is extended or adjusted under 35 U.S.C. 154(b) by 408 days.

(21) Appl. No.: 12/450,311

(22) PCT Filed: Mar. 19, 2008

(86) PCT No.: PCT/SE2008/000202
§ 371 (c)(1),
(2), (4) Date: Jan. 20, 2010

(87) PCT Pub. No.: WO2008/115119
PCT Pub. Date: Sep. 25, 2008

(65) Prior Publication Data

US 2010/0139182 A1 Jun. 10, 2010

(30) Foreign Application Priority Data

Mar. 21, 2007 (SE) ..... 0700768

(51) Int. Cl.
*F16B 35/00* (2006.01)

(52) U.S. Cl.
USPC ..... 411/392; 411/384; 248/330.1; 248/330

(58) Field of Classification Search
USPC ..... 411/384, 392, 387.1
See application file for complete search history.

(56) References Cited

U.S. PATENT DOCUMENTS 1,982,565 A 11/1934 Barge
2,856,556 A * 10/1958 Fentress ..... 315/5.22
4,387,497 A 6/1983 Gulistan
4,565,039 A * 1/1986 Oguro et al. ..... 52/167.4
4,787,592 A 11/1988 Aoshika
(Continued)

FOREIGN PATENT DOCUMENTS

DE 1 163 519 2/1964
DE 198 54 162 A1 7/1999
(Continued)

OTHER PUBLICATIONS

International Search Report for PCT/SE2008/000202, mailed Jun. 3, 2008.

(Continued)

*Primary Examiner* — Gary Estremsky
(74) *Attorney, Agent, or Firm* — Capitol City TechLaw

(57) ABSTRACT

The present invention encompasses an arrangement for resilient fixing and where the arrangement (3) is intended to be able to be fixedly anchored in a first, for instance a fixed and bearing, construction (1) and in such a fixedly anchored position be able to retain a second, for instance a laterally related and/or sub-oriented, construction (2), where the arrangement (3) displaying a first part portion (3*a*) for instance provided with a helical thread, cooperable with the first construction (1) and a second part portion (3*b*) for instance provided with a helical thread, cooperable with the second construction (2). The first part portion (3*a*) and the second part portion (3*b*) are, via a rod-shaped device (3*c*), to be coordinated with one another, while spring means (4), for instance a helical spring unit (4*a*) is to be adapted, by tractive or compressive force to resiliently retain said second construction (2) at an adapted distance ("D") from said first construction (1).

17 Claims, 1 Drawing Sheet

(56) References Cited

U.S. PATENT DOCUMENTS

| | | | | | |
|---|---|---|---|---|---|
| 4,812,096 | A | * | 3/1989 | Peterson | 411/231 |
| 4,854,797 | A | * | 8/1989 | Gourd | 411/383 |
| 4,906,154 | A | * | 3/1990 | Sheppard | 411/392 |
| 4,947,502 | A | * | 8/1990 | Engelhardt | 470/9 |
| 4,947,607 | A | | 8/1990 | Stein | |
| 5,061,137 | A | * | 10/1991 | Gourd | 411/510 |
| 5,102,276 | A | * | 4/1992 | Gourd | 411/392 |
| 5,104,271 | A | * | 4/1992 | Lechler | 411/166 |
| 5,336,928 | A | | 8/1994 | Neugebauer et al. | |
| 5,433,570 | A | * | 7/1995 | Koppel | 411/392 |
| 5,456,047 | A | * | 10/1995 | Dorka | 52/167.4 |
| 5,595,371 | A | * | 1/1997 | Hukuda et al. | 267/34 |
| 5,660,015 | A | * | 8/1997 | Kluser | 52/410 |
| 5,797,228 | A | * | 8/1998 | Kemeny | 52/167.7 |
| 6,179,537 | B1 | * | 1/2001 | Anders | 411/392 |
| 6,195,949 | B1 | * | 3/2001 | Schuyler | 52/223.13 |
| 6,234,735 | B1 | * | 5/2001 | Ganter | 411/384 |
| 7,662,173 | B2 | * | 2/2010 | Cragg et al. | 606/279 |
| 2005/0277940 | A1 | * | 12/2005 | Neff | 606/73 |
| 2007/0270855 | A1 | * | 11/2007 | Partin | 606/72 |

FOREIGN PATENT DOCUMENTS

| | | |
|---|---|---|
| EP | 0 185 447 A1 | 6/1986 |
| FR | 2 294 290 | 7/1976 |
| FR | 2 758 599 | 7/1998 |

OTHER PUBLICATIONS

Written Opinion of the International Searching Authority for PCT/SE2008/000202, mailed Jun. 3, 2008.

* cited by examiner

RESILIENT FIXING ARRANGEMENT

This application is the U.S. national phase under 35 U.S.C. 371 International Application No. PCT/SE2008/000202 filed 19 Mar. 2008, which claims priority to Sweden Application No. 0700768-5 filed 21 Mar. 2007, the entire contents of each of which are hereby incorporated by reference.

TECHNICAL FIELD

The present invention relates in general to a fixing arrangement and more specifically to a resilient fixing arrangement, intended to be able to be anchored in a first, for instance in a fixed and bearing, construction and in such an anchored position be able resiliently to retain a second, for instance a laterally related and/or sub-oriented, construction.

The arrangement displays a first part portion cooperable with the first construction and a second part portion cooperable with the second construction.

The invention has as its principle object to be able in a simple and economical manner to create the preconditions for considerably reduced sound and/or thermal conductivity, between the first and the second construction, such as for example between a studwork frame, as a first construction, and an inner ceiling as a second construction.

The present invention may have its application as a sound damping arrangement, between a beam structure and an inner ceiling suspended in discrete points and is based on the feature that the arrangement is to be resilient, in order to damp the propagation of sound waves via vibration movements or the propagation of sound waves via sound bridges, under the utilisation of a thin resilient means and where said arrangement is "punctiform" and well distributed to cooperate with the ceiling and its construction.

BACKGROUND ART

Methods, arrangements and constructions relating to the above disclosed technical field and with a function and a nature which satisfy set requirements are previously known in a plurality of different embodiments.

As one example of background art as regards vibration damping rubber rings and/or resilient units, mention might be made of the contents of the following Patent Publications:

DE-A1-198 54 162
EP-A1-0185 447
FR-A-2 758 599
U.S. Pat. No. 5,336,928 and
U.S. Pat. No. 4,387,497

The present invention more specifically relates to a resilient fixing arrangement, intended to be able to be fixedly anchored to a first, for instance a fixed and bearing, construction, such as in the form of a studwork frame and in such a fixedly anchored position be able to retain a second, for instance a laterally related and/or a sub-related, construction, for instance a ceiling built up from studs and plasterboard panels, where each arrangement is to display a first part portion cooperable with the first construction and a second, part portion cooperable with the second construction.

As then regards the prior art, concerning a resilient or elastically suspended ceiling in a beam structure, so as to reduce sound transport from the beam structure to a subjacent space, there is proposed an arrangement, more closely described in appended FIG. 1, utilising a metal rail with a "U"-shaped cross section, where the one web or shank of the rail is longitudinally fixed to the beam structure and where the elongate portion interconnecting the shanks or webs is secured to the inner ceiling. The second shank is free for the elastic securement.

BRIEF SUMMARY OF THE PRESENT INVENTION

Technical Problem

Taking into account the circumstance that the technical considerations which a person skilled within the art must do in order to be able to offer a solution to one or more set technical problems is on the one hand initially a necessary insight into the measures and/or the sequence of measures to be implemented and on the other hand a necessary selection of the means required, in view hereof the following technical problems and considerations are likely to be relevant in the evolution of the subject matter of the present invention.

Taking into account the state of the art, as described in the foregoing, it is probably therefore likely to be seen as a technical problem to be able to realise the importance of, the advantages associated with and/or the technical measures and considerations which will be required in order in a sound-damping arrangement, which is to be able to offer on the one hand a resilient fixing and on the other hand a sound-damping effect, intended pointwise to be able to be anchored in a first, for instance a fixed and bearing, construction and in such an anchored position be able to retain a second, for instance a laterally related and/or sub-oriented construction, and where the sound-damping arrangement to this end is to display a first part portion cooperable with the first construction and a second part portion cooperable with the second construction, to be able to disclose the construction and offer the insight that the first part portion and the second part portion are to be coordinated in series with one another and a resilient means, such as a helical spring unit, is to be adapted, with tractive or compressive force, to spotwise resiliently retain said second construction at an adapted distance from (under) said first construction.

There resides a technical problem in being able to realise the importance of, the advantages associated with and/or the technical measures and considerations which will be required in order to cause the first part portion to be formed with a fixing means, such as a helically formed thread.

There resides a technical problem in being able to realise the importance of, the advantages associated with and/or the technical measures and considerations which will be required in order to cause the second part portion to be formed with a fixing means, such as helically formed thread.

There resides a technical problem in being able to realise the importance of the advantages associated with and/or the technical measures and considerations which will be required in order to cause said first part portion and said second part portion to be oriented in one another's extension and that the resilient means is to be adapted, related to said extension, to cooperate with the mutually facing end sections of said part portions.

There resides a technical problem in being able to realise the importance of, the advantages associated with and/or the technical measures and considerations which will be required in order to cause the resilient means to include a spring unit dimensioned for tractive forces or alternatively a spring unit dimensioned for compressive forces.

There resides a technical problem in being able to realise the importance of, the advantages associated with and/or the technical measures and considerations which will be required in order to cause the spring unit to be dimensioned with a spring constant or a "K" value of between $0.01 \cdot 10^6$ and $10.0 \cdot 10^6$ (N/m).

There resides a technical problem in being able to realise the importance of, the advantages associated with and/or the technical measures and considerations which will be required in order to cause the first part portion to be formed with a first fixing means, such as a thread adapted for wood.

There resides a technical problem in being able to realise the importance of, the advantages associated with and/or the technical measures and considerations which will be required in order to cause a tip of said first part portion to be adapted as a drill tip, with a diameter slightly less than the diameter given to the first means.

There resides a technical problem in being able to realise the importance of, the advantages associated with and/or the technical measures and considerations which will be required in order to cause the second part portion to be formed with a second fixing means, such as for example a thread adapted for wood, and intended to fixedly cooperate with a hole formed in the second construction.

There resides a technical problem in being able to realise the importance of, the advantages associated with and/or the technical measures and considerations which will be required in order within said second part portion to create a space, adapted in order to be able to accommodate a helical spring unit.

There resides a technical problem in being able to realise the importance of, the advantages associated with and/or the technical measures and considerations which will be required in order to cause said second part portion to be given the form of a sleeve, rotatably coordinated with a rod-shaped device to which said first part portion is non-rotationally connected.

There resides a technical problem in being able to realise the importance of, the advantages associated with and/or the technical measures and considerations which will be required in order to cause said second part portion to be axially displaceable along a rod-shaped device and in a slightly compressed displacement position there are cooperating means in order simultaneously to make for the rotation of both said second part portion and said rod-shaped device.

There resides a technical problem in being able to realise the importance of, the advantages associated with and/or the technical measures and considerations which will be required in order in a slightly protracted displacement position to cause said second part portion to be rotatably disposed about a rod-shaped device, for an adjustment of said second construction in relation to said first construction or vice versa.

There resides a technical problem in being able to realise the importance of, the advantages associated with and/or the technical measures and considerations which will be required in order to cause, in a second embodiment, the first part portion and the second part portion to be co-ordinately formed as a first part portion, provided with a first thread, such as a wood screw thread, and a second part portion, provided with a second thread, for instance a metric thread.

There resides a technical problem in being able to realise the importance of, the advantages associated with and/or the technical measures and considerations which will be required in order to cause said second part portion to be divided in two, with the parts axially displaced from one another, but still retained in such a displaced position by an axially disposed resilient unit will be adapted to cooperate with the grooves of the thread.

There resides a technical problem in being able to realise the importance of, the advantages associated with and/or the technical measures and considerations which will be required in order to cause said resilient unit to be formed as a helical spring, with a radius connecting to a radius of said second part portion and/or groove of the thread.

There resides a technical problem in being able to realise the importance of, the advantages associated with and/or the technical measures and considerations which will be required in order to cause the section of said division in two to leave threaded part sections on each side of the section and that said resilient unit is to be adapted to cooperate with groove-formed thread sections on either side of the division in two.

There resides a technical problem in being able to realise the importance of, the advantages associated with and/or the technical measures and considerations which will be required in order to cause said resilient unit to be adapted with a thread pitch approximating an allocated thread pitch of said second part portion.

There resides a technical problem in being able to realise the importance of, the advantages associated with and/or the technical measures and considerations which will be required in order to cause a first end portion and end section, facing towards the division in two, and a second end portion and end section, facing towards said division in two, to display mutually fixedly coordinating coupling means.

There resides a technical problem in being able to realise the importance of, the advantages associated with and/or the technical measures and considerations which will be required in order to cause said coupling means to be coordinable in order to be able to transmit a torque between one another, under the utilisation of an axially directed force working against the spring action, operative within the axial direction of the second part portion towards the first part portion.

There resides a technical problem in being able to realise the importance of, the advantages associated with and/or the technical measures and considerations which will be required in order to cause the end portion or end section of the first part portion to display an irregular axially related pin while the end portion or end section of the second part portion is to display an axially related hole corresponding to the pin.

There resides a technical problem in being able to realise the importance of, the advantages associated with and/or the technical measures and considerations which will be required in order to cause said displacement to be adapted to a selected distance, for instance corresponding to a selected diameter of the second part portion.

There resides a technical problem in being able to realise the importance of, the advantages associated with and/or the technical measures and considerations which will be required in order to cause the helically adapted extent of the resilient unit over the section of the division in two to constitute a sound and/or heat reducing bridge.

There resides a technical problem in being able to realise the importance of, the advantages associated with and/or the technical measures and considerations which will be required in order to make for the provision around the rod-shaped device of an elastic damping, for instance in the form of a viscoelastic layer.

SOLUTION

In such instance, the present invention takes as its point of departure the prior art as disclosed by way of introduction and is intended to create a resilient fixing arrangement, adapted to be able to be anchored in a first, such as a fixed and bearing, construction and in such an anchored position to be able to fixedly retain a second, such as a laterally related and/or a sub-oriented, construction, where the arrangement displaying a first part portion cooperable with the first construction and a second part portion, cooperable with the second construction.

In order to be able to resolve one or more of the above-disclosed technical problems, the present invention more specially discloses that the prior art technique is to be supplemented by the feature that the first part portion and the second part portion are, e.g. via a rod-shaped or similar device, are to be coordinated in series and axially with one another and that a resilient means is to be adapted to make for the connection between said first and second part portions in order with a tractive and/or compressive force resiliently and axially resiliently to be able to fixedly retain said second construction at an adapted distance from said first construction.

As proposed embodiments, falling within the scope of the basic concept of the present invention, it is moreover disclosed that the first part portion should be formed with a fixing means, such as a helically formed thread, while the second part portion should be formed with a fixing means, such as a helically formed thread.

Said first part portion and said second part portion are to be oriented in one another's extension and the spring means is to be adapted, related to said extension, to cooperate with the mutually facing end sections of said part portions.

It is further disclosed that the spring means can include a spring unit dimensioned for tractive forces, alternatively a spring unit dimensioned for compressive forces.

More specially it is disclosed that the spring unit will advantageously be able to be dimensioned with a spring constant of between $0.01 \cdot 10^6$ and $10.0 \cdot 10^6$ (N/m).

It is further disclosed that the first part portion may advantageously be formed with a thread adapted for wood.

It is further disclosed that a tip of said first part portion may be adapted as a drill tip, with a diameter slightly less than the groove related diameter given to the first thread.

The invention more specially discloses that the second part portion can advantageously be formed with a thread adapted for wood and is intended to cooperate with a hole formed in the second construction.

Within said second part portion is formed and there exists a space, adapted to be able to accommodate a helically formed spring unit.

Said second part portion may then be given the form of a sleeve, rotatably coordinated with a rod-shaped device, to which said first part portion is non-rotationally connected.

Said second part portion may be axially displaceable along a rod-shaped device and in a slightly axially compressed displacement position there are means for simultaneously allowing rotation of both said second part portion and said rod-shaped device.

In a slightly separated displacement position said second part portion should be rotatably disposed about said rod-shaped device, for a positional adjustment of said second construction in relation to said first construction.

As a second embodiment of a resilient fixing arrangement, intended to be able to be fixedly anchored in a first, for instance a fixed and bearing, construction and in such a fixedly anchored position be able to retain a second, such as a laterally related or sub-oriented, construction, where the arrangement displaying a first part portion for instance provided with a helical thread, and cooperable with said first construction and a part portion for instance provided with a helical thread, cooperable with the second construction, the present invention discloses that the first part portion and the second part portion are to be coordinatedly formed as a first part portion, provided with a first thread, for instance a wood screw thread, and a second part portion provided with a second thread, for instance a metric thread.

As then regards the second embodiment, the present invention offers the feature that said second part portion is to be divided in two with a radial section, with the thus formed two parts or end sections slightly displaced from one another, but nevertheless fixedly retained in this disclosed displaced position by said resilient unit.

It is further disclosed that said resilient unit should be formed substantially as a helical spring and then with a radius corresponding to or slightly less than a selected radius for said second part portion.

The section for said division in two is advantageously to leave threaded portions on either side of the radial section and where said resilient unit is to be adapted to tightly cooperate with grooves in threaded sections on either side of the division in two.

Said resilient unit should then be adapted with a thread pitch corresponding to the thread pitch and a groove of said second part portion.

A first end portion or end section, facing towards the division in two, and a second end portion or end section, facing towards the division in two display mutually coordinable and corresponding coupling means.

Said coupling means are to be coordinable with one another in order to be able to transmit a torque between one another, under the utilisation of a force acting against the spring force within the axial direction of the second part portion and towards the first part portion.

It is proposed that the end portion of the first part portion is to display an irregular axially related pin while the end portion of the second part portion is to display an axially related hole corresponding to the pin.

It is further proposed that said displacement should be adapted to a distance, where this distance is to be corresponding to a selected diameter of the second part portion.

The linear adapted extent of the resilient unit, for instance of metal, over the section for the division in two thus constitutes the only mechanical sound and/or heat bridge.

Further, a bar-shaped device can cooperate with an elastic damping.

ADVANTAGES

The advantages which may principally be deemed to be characteristic of the present invention and the special significative characterising features disclosed thereby are that there have hereby been created the preconditions in order in a resilient fixing arrangement, intended to be able to be anchored in a first, for instance a fixed and bearing, construction and in such an anchored position be able to retain a second, for instance a laterally related and/or sub-oriented, construction, where the arrangement displaying a first, part portion cooperable with the first construction and a second part portion cooperable with the second construction, to disclose that the first part portion and the second part portion are, for instance via a rod-shaped device, to be in series and axially coordinated with one another and that a resilient means, for instance a helically formed spring unit formed of metal, is to be adapted to interconnect said first and said second part portions in order with a tractive or a compressive force resiliently and spotwise to make for the retention of said second construction at an adapted distance from said first construction.

That which may principally be deemed to be characteristic of the present invention is disclosed in the characterising clauses of appended Claims 1 and 15.

BRIEF DESCRIPTION OF THE ACCOMPANYING DRAWINGS

The prior art and a number of currently proposed embodiments, displaying the significative characterising features associated with the present invention, will now be described in greater detail hereinbelow for purposes of exemplification, with reference to the accompanying Drawings, in which.

Figure 3:
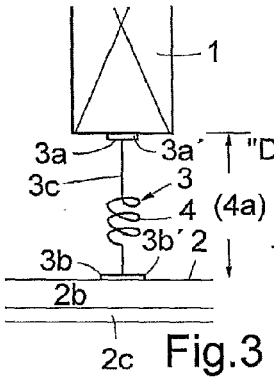
Figure 7:
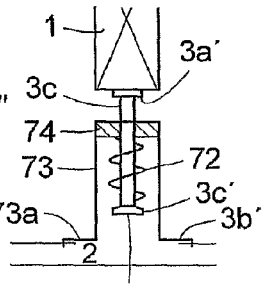
Figure 4:
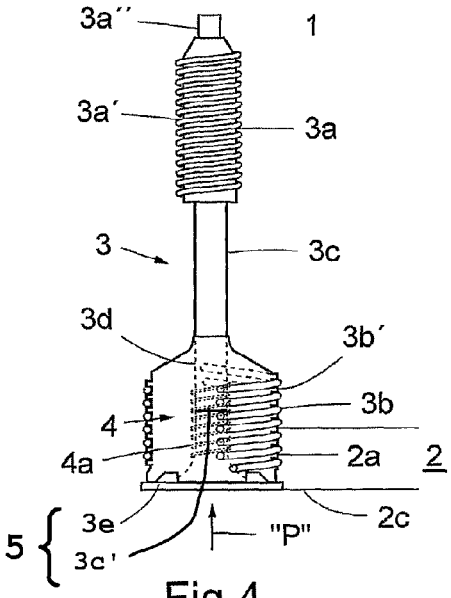
Figure 5:
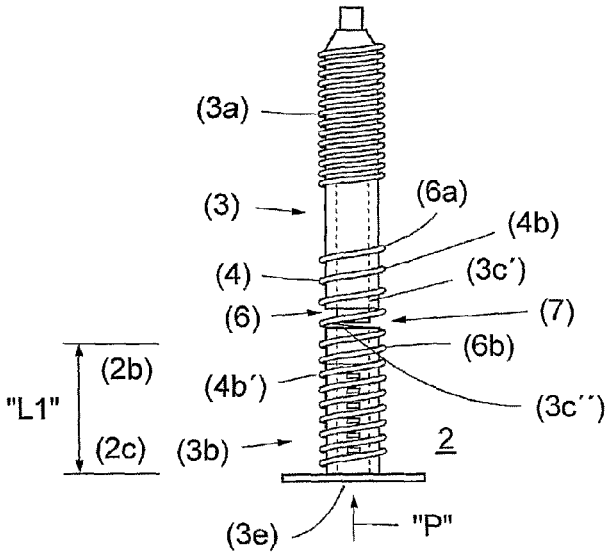
Figure 6:
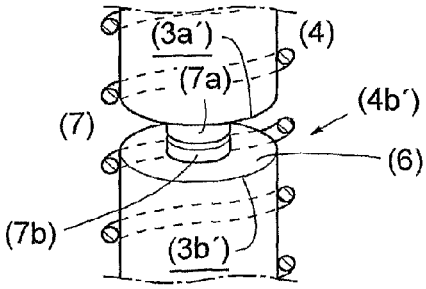

FIG. 3 illustrates a fixed studwork construction and a subjacent roof or ceiling construction where only one of among a plurality of requisite arrangements structured according to the invention are to be able suspended to fixedly retain the roof or ceiling construction for an extremely limited sound and/or heat conducting capacity, between the studwork construction and the roof or ceiling construction;

FIG. 4 is a side elevation and partly in section of an arrangement produced in accordance with the disclosures of the present invention, in a first embodiment;

FIG. 5 is a side elevation and partly in section of an arrangement produced in accordance with the disclosures of the present invention, in a second embodiment;

FIG. 6 is a perspective view of a coupling means with a surrounding spring unit; and FIG. 7 illustrates a third embodiment of an arrangement according to the present invention.

Figure 1:
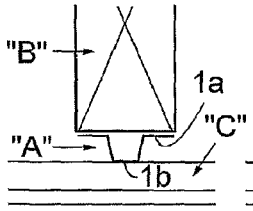
FIG. 1 is a section of a fixed studwork construction for a beam structure, with a prior art resilient "U"-shaped means fixedly connected via the one shank to a supporting beam and with an inner ceiling secured to an interjacent section for said means.
Figure 2:
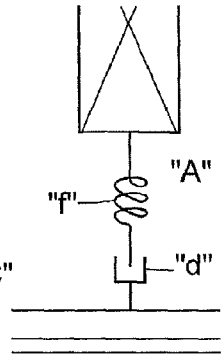
FIG. 2 illustrates the principal function of a resilient means with a provided spring unit and a provided damping unit connected in series.

DESCRIPTION OF PRIOR ART ARRANGEMENT FOR RESILIENTLY SUPPORTING A CEILING UNDER A BEAM STRUCTURE ACCORDING TO FIGS. 1 AND 2

With reference to FIG. 1, there is there shown a resilient fixing arrangement "A" intended to be able to be anchored in a first, for instance a fixed and bearing, beam construction "B" and in such an anchored position be able to retain a second, for instance a laterally related and/or sub-oriented, ceiling construction "C", where the arrangement "A" displaying a first part portion "1*a*" cooperable with the first construction "B" and a second part portion "1*b*" cooperable with the second construction "C".

The arrangement "A" here consists of a "U"-formed elongate rail whose one shank (right-hand shank) is fixedly related to the beam construction "B" and where the interconnecting centre portion "1*b*" of the shanks is fixed to the construction "C".

The resilient effect is here based on the fact that the rail "C" is only fixed with its one shank to the construction "B" while the other shank within the "U"-form is free.

The resilient effect is here based on a rotation along the elongate form of the one shank between the anchorages "1*a*" and "1*b*".

FIG. 2 is intended to illustrate that each resilient arrangement "A" can from the point of view of construction be considered as consisting of an ideal resilient unit "f" and an ideal damping unit "d".

Description of Currently Proposed Embodiment

By way of introduction, it should be emphasised that in the following description of one currently proposed embodiment, which displays the significative characterising features associated with the present invention and which has been clarified by means of the figures shown in the accompanying Drawings, we have selected terms and a special terminology with the intention in such instance principally of clarifying the inventive idea.

However, in this context it should be observed that expressions selected here should not be seen as restrictive exclusively to the terms utilised here and selected but it should be understood that every thus selected term is to be interpreted so that in addition it encompasses all technical equivalents which function in the same or substantially the same manner, in order in such instance to be able to attain the same or substantially the same intention and/or technical effect.

With reference to accompanying FIGS. 3 to 7, there are thus shown schematically and in detail not only the basic preconditions of the present invention but also the significative properties associated with the invention have been given concrete form as a result of the embodiments now proposed and more closely described hereinbelow.

Thus FIG. 3 shows in section in a fixed studwork construction 1 and a subjacent ceiling construction 2, with a stud 2*b* and a ceiling board 2*c* and where only one, among a plurality of necessary, arrangements 3 structured according to the invention are in suspended form to be able to fixedly retain the ceiling construction 2 for a resilient capability and with a very restricted mechanical sound and/or heat conductive capacity.

The resilient fixing arrangement 3, intended to be able to be fixedly anchored in a first, for instance a fixed and bearing, construction 1 and in such a fixedly anchored position be able to fixedly retain a second, for instance a laterally related and/or sub-oriented construction 2, where the arrangement 3 displaying a first part portion 3*a* cooperable with the first construction 1 and a second part portion 3*b* cooperable with the second construction 2.

The first part portion 3*a* and the second part portion 3*b* are in the axial direction coordinated with one another via a resilient unit 4*a* and/or via a rod-shaped device 3*c* (FIG. 4) coordinated with one another and that a resilient means 4 such as a helical spring unit 4*a*, is adapted with tractive or compressive force to resiliently retain said second construction 2 at an adapted distance "D" from said first construction 1.

The first part portion 3*a* is in FIG. 4 here shown formed with a first thread 3*a*' adapted for wood material, where a tip 3*a*" for said first part portion 3*a* is adapted as a drill tip, with a diameter slightly less than a diameter provided for the first thread 3*a*'.

The second part portion 3*b* is also formed with a thread 3*b*' adapted for wood and is intended to cooperate with a prefabricated hole 2*a* formed in the second construction 2.

The second part portion 3*b* is in FIG. 4 given a larger diameter than the first part portion 3*a*.

Within said second part portion 3*b* there is a space 3*d*, adapted to be able to accommodate the helical spring unit 4*a*.

Said second part portion 3*b* is in the form of a sleeve, rotatably coordinated with said rod-shaped device 3*c*, to which said first part portion 3*a* is non-rotationally connected or integrated.

Said second part portion 3*b* is axially displaceably disposed along said rod-shaped device 3*c*.

In a slightly compressed displacement position, there are means 5 (two screw grooves assume a mutually cooperating position, one screw groove 3*e* in the other part 3*b*, one screw groove 3*c*' in the lower end portion of the device 3*c*) in order with the aid of a tool, a screw driver, simultaneously to make for the rotation of both said second part portion 3*b* and said rod-shaped device 3*c*, under the activation of a compressive force "P".

In a slightly separated displacement position, said second part portion 3*b* is rotatably disposed about said rod-shaped device 3*c* for an adjustment of the distance "D" between said second construction 2 in relation to said first construction 1.

With reference to FIG. 5, there is there illustrated an alternative embodiment of a resilient fixing arrangement (3), intended to be able to be fixedly anchored in a first, for instance a fixed and bearing, construction 1 and in such a fixedly anchored position be able to retain a second, for instance a laterally related and/or sub-oriented, construction 2, where the arrangement (3) displaying a first, for instance a part portion (3*a*) provided for instance with a helical thread, cooperable with the first construction 1 and a part portion (3*b*) provided for instance with a helical thread, cooperable with the second construction 2.

It is here disclosed that the first part portion (3*a*) and the second part portion (3*b*) are to be coordinatedly formed as a first part portion (3*a*) provided with a first thread, for instance a wood screw thread, and a second part portion (3*b*) provided with a second thread, for instance a metric thread.

Said first and second part portions (3*a* and 3*b*) may form a unit that is here via a section (6) to be divided in two, with the parts or end sections (3*c*' and 3*c*") axially slightly displaced from one another, but retained in this displaced position by a resilient unit (4*b*).

Said resilient unit (4*b*) is formed as a helical screw with a radius corresponding to a radius of a groove within the thread of said second part portion (3*b*).

The radial section (6) for said division in two leaves threaded part portions (6*a*, 6*b*) on either side of the section and where said resilient unit (4*b*) is to be adapted to cooperate with thread sections on either side of this division in two (6).

Said resilient unit (4*b*) should then be adapted with a thread pitch corresponding to a selected thread pitch for said second part portion (3*b*).

A first end portion (3*a*'), facing towards the section (6) of the division in two, and a second end portion (3*b*'), facing towards the section (6) for the division in two display end portions (3*c*') and (3*c*") and with mutually cooperable coupling means (7).

Said coupling means (7) are here to be coordinable in order to be able to transmit an axially-related torque between one another, but under the utilisation of a force "P" acting against spring force, in the axial direction of the second part portion (3*b*) towards the first part portion (3*a*).

The end portion (3*a*') of the first part portion (3*a*) displays an irregular axially-related and centred pin (7*a*), while the end portion (3*b*') of the second part portion (3*b*) displays a corresponding axially-related and centred hole (7*b*) corresponding with the pin (7*a*).

Said displacement, corresponding to the section (6) is adapted to a distance corresponding to a selected diameter of the second part portion (3*b*).

The helical adapted thin and short mechanical extent (4*b*) of the resilient unit (4*b*) over the section (6) for the division in two constitutes the only mechanical sound and/or heat bridge.

It should be specially observed that the section (6) for the division in two is to be laid so that the length "L1" of the lower section (3*b*) is to connect to or slightly exceed the allocated thickness of the second construction 2 with a stud (2*b*) and a plasterboard (2*c*).

The mechanical sound and/or heat bridge (4*b*') can further reduce sound and heat transport by forming the spring section (4*b*') from a sound and heat damping material.

The first part portion 3*a* is formed with a fixing means adjacent the end portion 3*a*', for instance to a helically formed thread, while the second part portion (3*b*) is formed with a fixing means adjacent the end portion (3*b*'), for instance to a helically formed thread.

Said first part portion (3*a*) and said second part portion (3*b*) are oriented in one another's extension and the spring means (4) is adapted, related to said extension, to cooperate with the mutually facing end portions (3*a*') and (3*b*'), respectively, of said part portions.

The spring means (4) can then include a spring unit (FIG. 3) dimensioned for tractive forces, alternatively a spring unit (FIG. 7) dimensioned for compressive forces.

The spring unit (4) is here dimensioned to display a spring constant or "K" value between $0.01\cdot10^6$ and $10.0\cdot10^6$ (N/m).

The present invention requires for its sound-damping function a selection of a spring constant "K" (N/m).

Such a spring constant will be dependent upon the selected frequency (f) of the sound wave which is to be damped, the number of connection points (n), the mass (m) which the spring is to support according to the formula $$n\cdot K=(f\cdot 2\pi)^2\cdot m$$

which will have a frequency (f) of 50 Hz, the number of connection points (n)=1 and the mass approx. 9 kg/m$^2$ gives a "K" value of $0.8\cdot10^6$ (N/m) at m=18 kg/m$^2$ a "K" value of $1.6\cdot10^6$ (N/m).

At n=7, m=9 there will be obtained a "K" value of $0.13-10^6$ (N/m).

Thus falling within the scope of the invention are "K" values between $0.01\cdot10^6$ and $10.0\cdot10^6$ (N/m).

FIG. 7 here illustrates that a rod 3*c* is secured 3*a*' to a beam 1 where the lower part 3*c*' of the rod 3*c* cooperates with a support plate 71 for a spring unit 72.

The upper portion of the compression spring 72 is enclosed by a sleeve 73 which in its lower part 73*a* is secured to the construction 2.

A special movement damping unit 74 corresponding ("d" in FIG. 2) is clamped in between the rod 3*c* and the upper part of the sleeve 73. This unit can be made from a viscoelastic material, in particular rubber, plastic or the like is proposed.

Naturally the invention is not restricted to the embodiment described by way of example in the foregoing, but may undergo modifications without departing from the scope of the inventive concept as illustrated in the appended Claims.

It should specially be observed that every illustrated unit and/or circuit is to be able to be combined with every other illustrated unit and/or circuit within the scope in order to be able to attain the desired technical function.

The invention claimed is:

1. A resilient fixing arrangement intended to be anchored in a first construction that is a studwork construction, and in such an anchored state be able to fixedly retain a second construction, such as an inner ceiling construction, the resilient fixing arrangement comprising:

a first part portion cooperable with the first construction, a second part portion cooperable with the second construction, wherein a total length of the resilient fixing arrangement along a longitudinal axis thereof is defined between an end point of the first part portion and an end point of the second part portion, a rod-shaped device at a first end rigidly connected to the first part portion, a resilient intermediate portion connected to:

the rod-shaped device and extending in a longitudinal direction from a second end of the rod-shaped device, wherein the second end is oppositely arranged to the first end of the rod-shaped device, and a first part of the second part portion, wherein the resilient intermediate portion acts to:

longitudinally separate the rod-shaped device and the first part of the second part portion; and retain the first part portion from the second part portion at a longitudinal distance, thereby preventing the first part portion from coming into contact with the second part portion, and means for simultaneously permitting rotation of both the first part portion and the second part portion, wherein the first part portion is formed with a helically formed thread, and wherein a tip for said first part portion is adapted as a drill tip, with a diameter less than the diameter provided for the helically formed thread.

2. The arrangement as claimed in claim 1, wherein the second part portion is axially displaceable along the rod-shaped device, and wherein the second part portion is rotatably disposed about the rod-shaped device, for an adjustment of the second construction in relation to the first construction or for an adjustment of the first construction in relation to the second construction.

3. The arrangement as claimed in claim 1, wherein the second part portion is formed with a helically formed thread.

4. The arrangement as claimed in claim 1, wherein the first part portion and the second part portion are co-axially aligned, in that the resilient intermediate portion is adapted to cooperate with the mutually facing end sections of the first and the second part portions.

5. The arrangement as claimed in claim 1, wherein the resilient intermediate portion includes a spring.

6. The resilient fixing arrangement, according to claims 5, wherein the resilient intermediate portion is dimensioned with a spring constant of $0.01 \cdot 10^6 - 10.0 \cdot 10^6$ N/m.

7. The arrangement as claimed in claim 1, wherein the resilient intermediate portion includes a helical spring.

8. The resilient fixing arrangement, according to claims 7, wherein the resilient intermediate portion is dimensioned with a spring constant of $0.01 \cdot 10^6 - 10.0 \cdot 10^6$ N/m.

9. The arrangement as claimed in claim 1, wherein the second part portion is formed with a thread.

10. The arrangement as claimed in claim 1, wherein the second part portion comprises a space adapted to accommodate a helical spring unit.

11. The arrangement as claimed in claim 1, wherein the second part portion is in the form of a sleeve.

12. The arrangement as claimed in claim 1, wherein the resilient intermediate portion includes a tension spring.

13. A method of mounting the resilient fixing arrangement according to claim 1 to a first construction and a second construction, the method comprising:

inserting the first part portion and the resilient intermediate portion through a hole formed in the second construction, applying a force acting against the spring force of the resilient intermediate portion, in an axial direction of the second part portion towards the first part portion, thereby coupling the first part portion to the second part portion in an axially compressed displacement position, and rotating the resilient fixing arrangement while being in the compressed displacement position, thereby simultaneously screwing the first part portion into the first construction and the second part portion into the hole of the second construction.

14. A resilient fixing arrangement intended to be anchored in a first construction, and in such an anchored state be able to retain a second construction, the resilient fixing arrangement comprising:

a first part portion having a first end with a first outer thread for rigidly attaching the first part portion to the first construction, and a second end with a second outer thread, a second part portion having a first end with a third outer thread, and a second end provided with a screw groove, and a helical spring having a first part attached to the second outer thread of the first part portion, and a second part attached to the third outer thread of the second part portion, wherein a first end portion at the second end of the first part portion and a second end portion at the first end of the second part portion are engageable to transmit torque between the first part portion and the second part portion.

15. A method of mounting the resilient fixing arrangement according to claim 14 to a first construction and a second construction, the method comprising:

inserting the first part portion and the helical spring through a hole formed in the second construction, applying a force acting against the spring force of the helical spring, in an axial direction of the second part portion towards the first part portion, thereby engaging the first end portion of the first part portion with the second end portion of the second part portion in an axially compressed displacement position, and rotating the resilient fixing arrangement while being in the compressed displacement position, thereby simultaneously screwing the first part portion into the first construction and the second part portion into the hole of the second construction.

16. A system comprising:

the resilient fixing arrangement according to claim 14, a first construction, and a second construction, wherein the resilient fixing arrangement is attached to the first construction and the second construction, and wherein the helical spring is configured to retain the first construction from the second construction at a longitudinal distance.

17. A system comprising:

the resilient fixing arrangement according to claim 1, a first construction, and a second construction, wherein the resilient fixing arrangement is attached to the first construction and the second construction, and wherein the resilient intermediate portion is configured to retain the first construction from the second construction at a longitudinal distance.

* * * * *